US007207300B2

(12) United States Patent
Ezaki et al.

(10) Patent No.: US 7,207,300 B2
(45) Date of Patent: Apr. 24, 2007

(54) VARIABLE VALVE MECHANISM

(75) Inventors: Shuichi Ezaki, Susono (JP); Toshiaki Asada, Mishima (JP); Manabu Tateno, Sunto-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/548,199

(22) PCT Filed: Dec. 14, 2004

(86) PCT No.: PCT/JP2004/018972

§ 371 (c)(1),
(2), (4) Date: Sep. 7, 2005

(87) PCT Pub. No.: WO2005/068787

PCT Pub. Date: Jul. 28, 2005

(65) Prior Publication Data

US 2006/0213469 A1 Sep. 28, 2006

(30) Foreign Application Priority Data

Jan. 15, 2004 (JP) ..... 2004-008293

(51) Int. Cl.
*F01L 1/34* (2006.01)

(52) U.S. Cl. ..... 123/90.16; 123/90.17; 123/90.31

(58) Field of Classification Search ..... 123/90.15, 123/90.16, 90.17, 90.18, 90.27, 90.31
See application file for complete search history.

(56) References Cited

U.S. PATENT DOCUMENTS

| | | | | |
|---|---|---|---|---|
| 5,033,421 | A * | 7/1991 | Shimada et al. | 123/90.27 |
| 6,419,607 | B1 * | 7/2002 | Wild et al. | 475/88 |
| 6,457,446 | B1 * | 10/2002 | Willmot | 123/90.17 |
| 6,497,206 | B2 * | 12/2002 | Nohara et al. | 123/90.16 |

FOREIGN PATENT DOCUMENTS

| | | |
|---|---|---|
| JP | A 02-233811 | 9/1990 |
| JP | A 05-231107 | 9/1993 |
| JP | A 10-169421 | 6/1998 |
| JP | A 2001-123810 | 5/2001 |
| JP | A 2001-182505 | 7/2001 |
| JP | A 2002-371816 | 12/2002 |

* cited by examiner

*Primary Examiner*—Ching Chang
(74) *Attorney, Agent, or Firm*—Oliff & Berridge, PLC

(57) ABSTRACT

Intake camshafts 10, 14 for driving valve bodies 32 (intake valve) are positioned in right- and left-hand banks, respectively. A variable valve mechanism 30 is positioned in each of the right- and left-hand banks in such a manner as to form mirror-image symmetry. The variable valve mechanism 30 includes a control shaft 60 for controlling the operating angle of the valve body. The respective control shafts in the right- and left-hand banks are controlled in symmetrical directions. The right- and left-hand intake camshafts 10, 14 rotate in opposite directions and at a speed that is synchronized with the speed of a crankshaft.

6 Claims, 9 Drawing Sheets

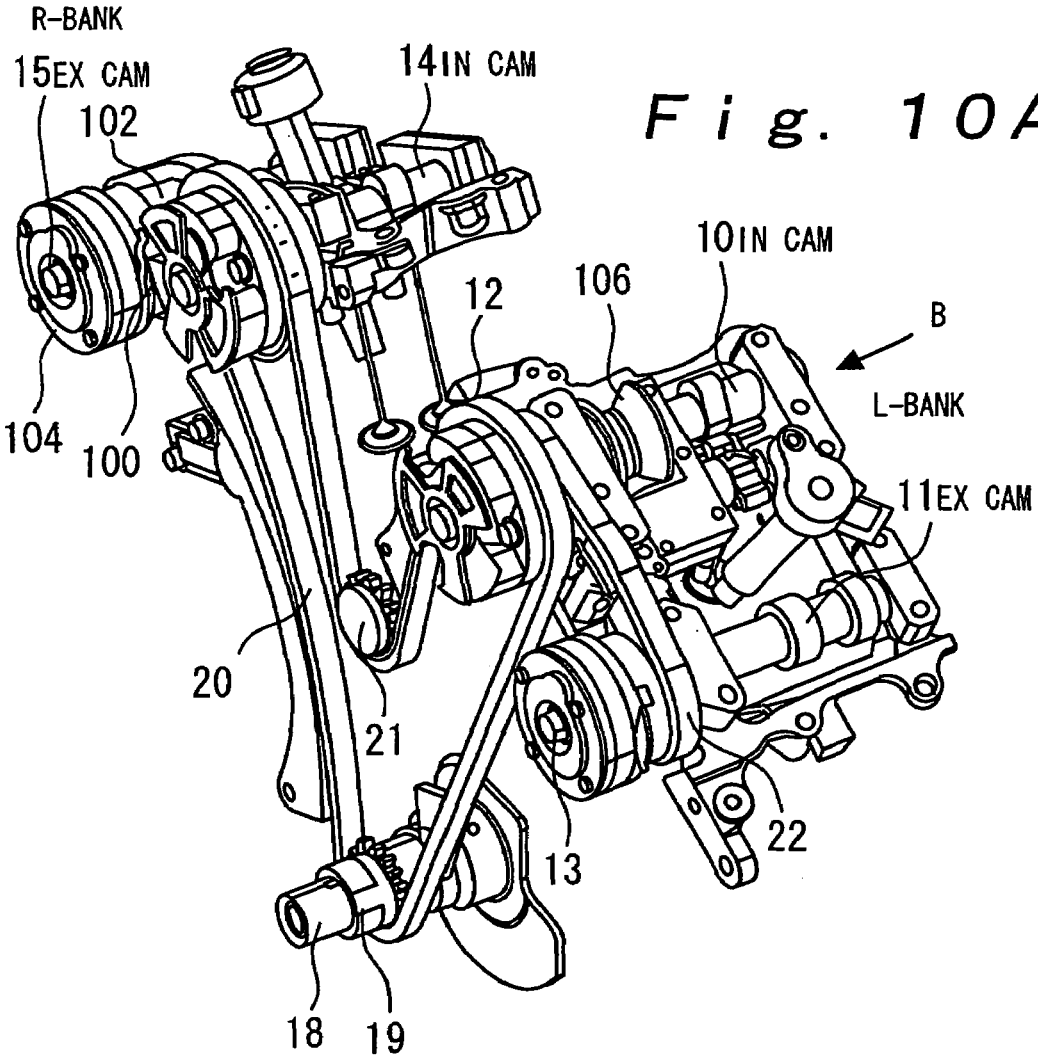
Fig. 10A
Fig. 10B
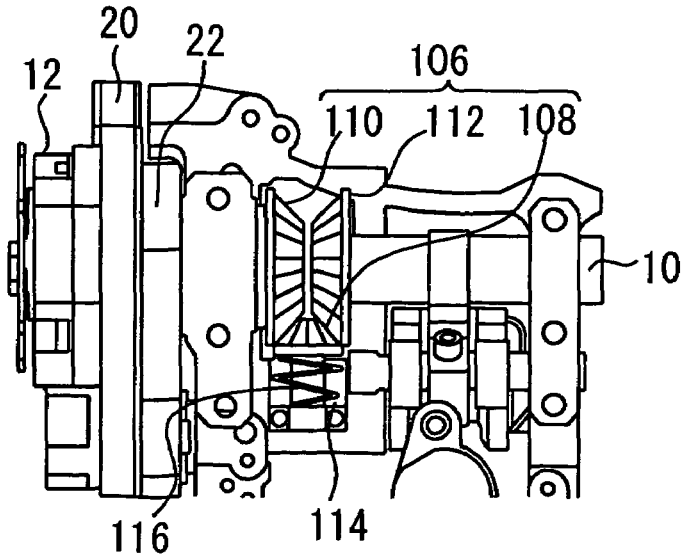

VARIABLE VALVE MECHANISM

TECHNICAL FIELD

The present invention relates to a variable valve mechanism for a V-type internal combustion engine, and more particularly to a variable valve mechanism for a V-type internal combustion engine in which both banks each include a mechanism for changing the operating angle and valve opening phase of a valve body that opens/closes in synchronism with camshaft rotation.

BACKGROUND ART

A variable valve mechanism for changing the operating angle, lift amount, and valve opening phase of a valve body that is provided in an internal combustion engine to open/close in synchronism with camshaft rotation is disclosed, for instance, by Japanese Patent Laid-open No. 2002-371816. This variable valve mechanism includes a swing arm, which is positioned between a cam and the valve body to swing in synchronism with cam operation. The swing arm is installed in the internal combustion engine with a certain degree of freedom so that the basic relative angle in relation to the valve body can be varied. This mechanism also includes a variable mechanism for varying the relative angle between the swing arm and the valve body in accordance with control shaft rotation.

When a control shaft turns within the variable valve mechanism described above, the reference relative angle between the swing angle and the valve body varies. When the relative angle varies, a change occurs in the time interval (crank angle) between the instant at which the pushing pressure of a cam begins to be transmitted to the swing arm, that is, the swing arm begins to swing due to cam action, and the instant at which the swing arm actually begins to depress the valve body. Therefore, when the control shaft rotation position is controlled, the conventional mechanism described above can vary the crank angle width (hereinafter referred to as the "operating angle") for placing the valve body in a non-closed state as well as the lift amount to be applied to the valve body.

Further, the conventional variable valve mechanism described above is configured so that the timing for causing a cam nose to start pushing the swing arm advances when the control shaft turns in the direction of small operating angle/small lift. When such a configuration is employed, the valve opening phase of the valve body advances with a decrease in the operating angle of the valve body. It is therefore possible to ensure that the valve body opening timing remains virtually unchanged without regard to operating angle changes. The phenomenon in which the valve opening phase advances with a decrease in the operating angle as described above is hereinafter referred to as "phase coupling."

When the conventional variable valve mechanism described above is used as an intake valve drive mechanism, it is possible to implement the so-called non-throttle type internal combustion engine. In this instance, the functionality of the variable valve mechanism can be exercised to vary the intake valve operating angle and lift amount as desired. When the intake valve operating angle and lift amount can be freely controlled, it is possible, without using a throttle valve, to exercise intake air amount control in accordance with the operating angle and lift amount. In such an instance, no intake pipe negative pressure is generated. Therefore, it is possible to reduce the internal combustion engine pumping loss.

In a non-throttle type internal combustion engine, the amount of intake air changes to a greater extent when the intake valve closing timing is changed than when the intake valve opening timing is changed. It is therefore preferred that the intake valve closing timing greatly change in accordance with a change in the intake valve operating angle when the amount of intake air is to be controlled in accordance with the intake valve operating angle.

As a result of phase coupling, the conventional variable valve mechanism described above changes the valve body closing timing greatly when the operating angle changes, as described earlier. In a non-throttle type internal combustion engine, therefore, this variable valve mechanism can control the amount of intake air with sufficiently high accuracy.

The applicant of the present invention has acknowledged that the following documents relate to the present invention in addition to the above-mentioned document.

[Patent Document 1] Japanese Patent Laid-open No. 2002-371816

[Patent Document 2] Japanese Patent Laid-open No. 2001-123810

[Patent Document 3] Japanese Patent Laid-open No. Hei 10-169421

DISCLOSURE OF INVENTION

The V-type internal combustion engine has two banks, which are tilted symmetrically. The banks are configured so that an intake port and exhaust port are in a relationship of a mirror arrangement of each other. Camshafts provided in the individual banks are generally rotated in the same direction in synchronism with a crankshaft via chains and gears.

When the conventional variable valve mechanism described above is to be installed in the V-type internal combustion engine, the variable valve mechanism may be mounted in each bank so that the mechanisms are in a relationship of a mirror arrangement of another. The two banks are positioned so that the intake side and exhaust side are in a relationship of a mirror arrangement of each other. Therefore, when the installed variable valve mechanisms are in a relationship of a mirror arrangement of each other, the variable valve mechanisms and other components in the banks are symmetrical with each other. When this configuration is employed, the same variable valve mechanism can easily be used in the two banks.

However, the camshafts installed in the banks of the V-type internal combustion engine rotate in the same direction. If the variable valve mechanisms are positioned in the banks in a manner of a mirror arrangement, the camshaft in one bank rotates in the normal direction in relation to the variable valve mechanism, whereas the camshaft in the other bank rotates in the reverse direction in relation to the variable valve mechanism.

While the cam rotates in the normal direction, the conventional variable valve mechanism described above exhibits the above-mentioned phase coupling characteristic, that is, advances the timing with which the cam nose begins to push the swing arm when the swing arm turns in such a direction as to decrease the operating angle. The timing with which the cam nose begins to push the swing arm (hereinafter referred to as the "push start timing") advances or retards depending on the direction of camshaft rotation.

In other words, if the swing arm's turn in the small operating angle direction advances the push start timing while the cam rotates in the normal direction, the swing arm's turn in the small operating angle direction retards the push start timing while the cam rotates in the reverse direction. Therefore, when the conventional variable valve mechanisms described above are installed in the V-type internal combustion engine in such a manner of a mirror arrangement, phase coupling is properly provided in one bank, but reversely provided in the other bank. In this instance, the amount of intake air can be controlled with high accuracy in one bank, but such control accuracy cannot be attained in the other bank.

The present invention has been made to solve the above problem. It is an object of the present invention to provide a V-type internal combustion engine variable valve mechanism that is capable of providing proper phase coupling in both of the two banks while using a mirror arrangement configuration, which is beneficial for parts commonality.

To achieves the above-mentioned purpose, the first aspect of the present invention is a variable valve mechanism for use in a V-type internal combustion engine comprising:

a first camshaft and a second camshaft, which are respectively positioned in a first bank and in a second bank to drive valve bodies of the same type;

a first variable valve mechanism and a second variable valve mechanism, which are respectively positioned in the first bank and the second bank so as to satisfy a relationship of a mirror arrangement and transmit a pushing pressure to the valve bodies in the banks in accordance with the rotation of the first camshaft or the second camshaft; and a camshaft drive mechanism for rotating the first camshaft and the second camshaft in opposite directions and at a speed that is synchronized with the speed of a crankshaft, wherein each of the first variable valve mechanism and the second variable valve mechanism includes a mechanism for changing an operating angle of the valve body and a valve opening phase of the valve body in accordance with the status of a control shaft, and a control shaft drive mechanism for controlling the status of the control shaft; and wherein the control shaft drive mechanism included in the first variable valve mechanism and the control shaft drive mechanism included in the second variable valve mechanism control the associated control shafts symmetrically.

A second aspect of the present invention is the variable valve mechanism for use in the V-type internal combustion engine according to the first aspect of the invention, wherein the first bank and the second bank each include an intake camshaft for driving an intake valve and an exhaust camshaft for driving an exhaust valve;

wherein the valve bodies of the same type are the intake valves; and wherein the camshaft drive mechanism includes:

a power transmission mechanism for transmitting the rotation of the crankshaft to an intake camshaft in one bank and an exhaust camshaft in the other bank;

a gear mechanism for transmitting the reversal of the rotation of the exhaust camshaft in the other bank; and a rotation transmission mechanism for transmitting the rotation of the gear mechanism to an intake camshaft in the other bank.

A third aspect of the present invention is the variable valve mechanism for use in the V-type internal combustion engine according to the first aspect of the invention, wherein the first bank and the second bank each include an intake camshaft for driving an intake valve and an exhaust camshaft for driving an exhaust valve;

wherein the valve bodies of the same type are the intake valves; and wherein the camshaft drive mechanism includes:

an idler gear that rotates in a direction opposite to the direction in which the crankshaft rotates;

a power transmission mechanism for transmitting the rotation of the crankshaft to an intake camshaft in one bank and an exhaust camshaft in the other bank; and a rotation transmission mechanism for transmitting the rotation of the idler gear to an intake camshaft in the other bank.

A fourth aspect of the present invention is the variable valve mechanism for use in the V-type internal combustion engine according to the first aspect of the invention, wherein the first bank and the second bank each include an intake camshaft for driving an intake valve and an exhaust camshaft for driving an exhaust valve;

wherein the valve bodies of the same type are the intake valves; and wherein the camshaft drive mechanism includes:

a crank gear that is fastened to the crankshaft;

a first intake cam gear that is fastened to an intake camshaft in one bank;

an exhaust cam gear that is fastened to an exhaust camshaft in the other bank;

a second intake cam gear that is fastened to an intake camshaft in the other bank; and a chain or a belt that is positioned in contact with the crank gear, the first intake cam gear, and the exhaust cam gear via a front surface and in contact with the second intake cam gear via a back surface to transmit power among the gears.

A fifth aspect of the present invention is the variable valve mechanism for use in the V-type internal combustion engine according to the first aspect of the invention, wherein the first camshaft and the second camshaft are the first intake camshaft for driving an intake valve in one bank and the second intake camshaft for driving an intake valve in the other bank, respectively; and wherein the camshaft drive mechanism includes:

a first bevel gear that is fastened to the first intake cam;

a second bevel gear that is positioned to face the first bevel gear;

a third bevel gear that meshes with both the first bevel gear and the second bevel gear to transmit the rotation of the second bevel gear to the first bevel gear in such a manner that the first bevel gear rotates in a direction opposite to the direction in which the second bevel gear rotates; and a power transmission mechanism for transmitting the rotation of the crankshaft to the second intake camshaft and the second bevel gear.

A sixth aspect of the present invention is the variable valve mechanism for use in the V-type internal combustion engine according to the fifth aspect of the invention, further comprising a backlash buffer mechanism for pushing the third bevel gear toward the first bevel gear and the second bevel gear.

The first aspect of the present invention makes it possible to position the first and second variable valve mechanisms, which exhibit the phase coupling characteristic, in the first and second banks in such a manner as to provide a relationship of a mirror arrangement. Since the control shafts are symmetrically controlled, the variable valve mechanisms can vary the valve body operating angles in the two banks in the same manner. Further, the first aspect of the present invention can rotate the first and second camshafts, which are positioned in the banks, in opposite directions. It is therefore possible to provide both the first and second variable valve mechanisms with proper phase coupling.

The second aspect of the present invention permits the first and second variable valve mechanisms to drive the intake valves in the two banks. In the second aspect of the present invention, the power transmission mechanism ensures that the intake camshaft in one band and the exhaust camshaft in the other bank rotate in the same direction. Further, the gear mechanism and rotation transmission mechanism operate so that the intake camshaft in the other bank rotates in a direction opposite to the direction in which the exhaust camshaft in the other bank rotates. As a result, the intake camshaft in one bank rotates in a direction opposite to the direction in which the intake camshaft in the other bank rotates.

The third aspect of the present invention permits the first and second variable valve mechanisms to drive the intake valves in the two banks. In the third aspect of the present invention, the power transmission mechanism ensures that the intake camshaft in one band and the exhaust camshaft in the other bank rotate in the same direction. Further, the rotation of the idler gear included in the power transmission mechanism is transmitted to the intake camshaft in the other bank so that the intake camshaft in one bank rotates in a direction opposite to the direction in which the intake camshaft in the other bank rotates.

The fourth aspect of the present invention permits the first and second variable valve mechanisms to drive the intake valves in the two banks. In the fourth aspect of the present invention, the crank gear, the first intake cam gear in one bank, and the exhaust cam gear in the other bank come into contact with the same surface of the chain or belt. Therefore, the intake camshaft in one bank and the exhaust camshaft in the other bank can rotate in the same direction as the crankshaft. Further, the fourth aspect of the present invention brings the rear surface of the above-mentioned chain or belt into contact with the second intake cam gear in the other bank. Therefore, the intake camshaft in the other bank can rotate in a direction opposite to the direction in which the intake camshaft in the remaining bank rotates.

The fifth aspect of the present invention can operate the power transmission mechanism to transmit the rotation of the crankshaft to the second intake camshaft and second bevel gear. In the fifth aspect of the present invention, the first to third bevel gears can reverse the rotation of the second bevel gear and transmit the reversed rotation to the first bevel gear. The rotation of the first bevel gear is directly transmitted to the first intake camshaft. Therefore, the fifth aspect of the present invention can rotate the first intake camshaft and second intake camshaft in opposite directions in synchronism with crankshaft rotation.

The sixth aspect of the present invention can operate the backlash buffer mechanism to press the third bevel gear against the first and second bevel gears. Therefore, the sixth aspect of the present invention can sufficiently control the backlash between the mating gear teeth of the first to third bevel gears.

BRIEF DESCRIPTION OF DRAWINGS

FIGS. 10A and 10B are a perspective view and an enlarged view, respectively, illustrating the overall configuration of a variable valve mechanism according to a fourth embodiment of the present invention.

BEST MODE FOR CARRYING OUT THE INVENTION

First Embodiment

[Overall Configuration of Variable Valve Mechanism]

Figure 1:
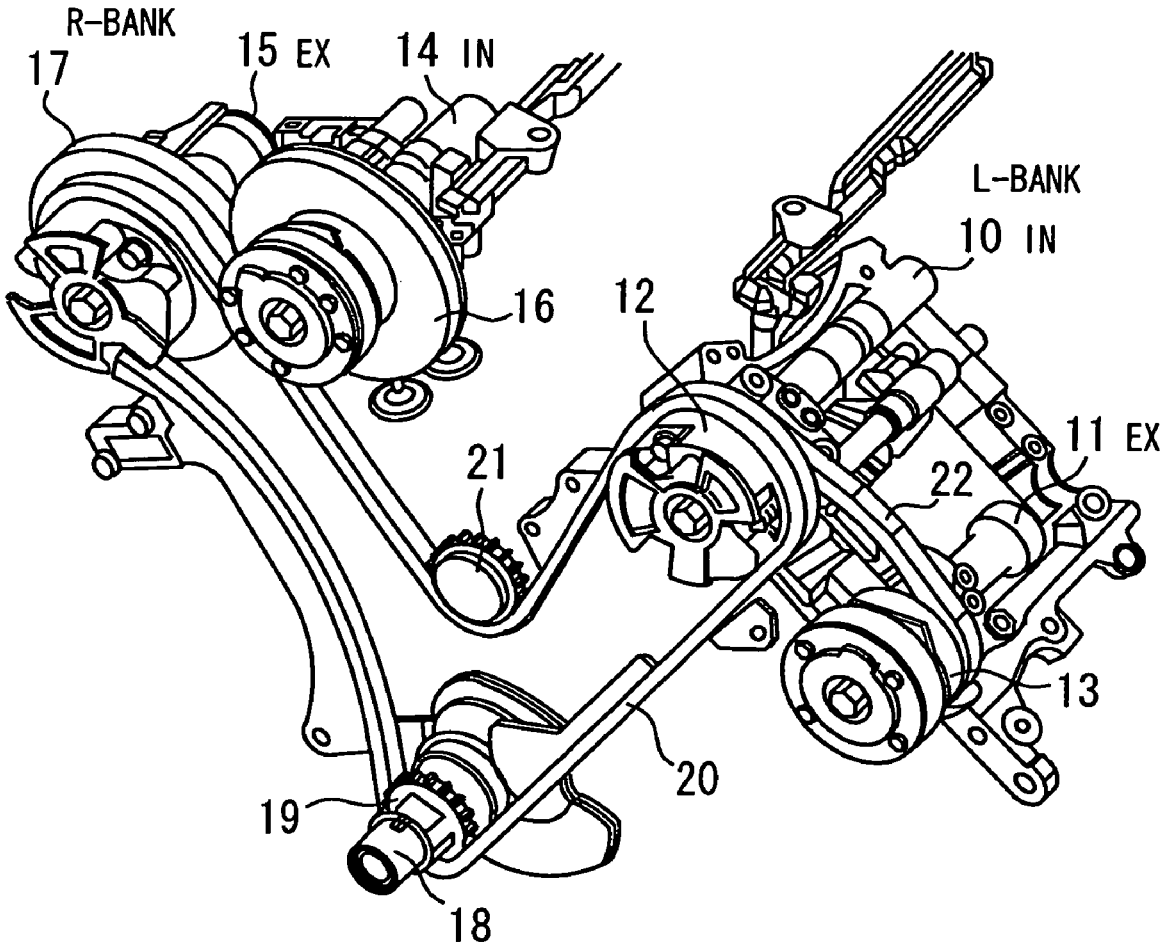
FIG. 1 is a perspective view illustrating the overall configuration of a variable valve mechanism according to a first embodiment of the present invention.

FIG. 1 is a perspective view illustrating the overall configuration of a variable valve mechanism according to a first embodiment of the present invention. The variable valve mechanism according to the present embodiment is a mechanism for changing the operating angle and lift amount of an intake valve in a V-type internal combustion engine. It is assumed that the V-type internal combustion engine according to the present embodiment is a so-called non-throttle type internal combustion engine, which controls the amount of intake air by varying the intake valve operating angle and lift amount with the variable valve mechanism and without using a throttle valve. In the subsequent description, the two banks provided in the V-type internal combustion engine are referred to as the left-hand bank and right-hand bank.

As shown in FIG. 1, the left-hand bank of the V-type internal combustion engine is provided with a left-hand intake camshaft 10 and a left-hand exhaust camshaft 11. A left-hand intake drive gear 12 and a left-hand exhaust driven gear 13 are respectively mounted on the ends of camshafts 10 and 11. The right-hand bank is provided with a right-hand intake camshaft 14 and a right-hand exhaust camshaft 15. A right-hand intake driven gear 16 and a right-hand exhaust drive gear 17 are respectively mounted on camshafts 14 and 15.

The V-type internal combustion engine includes a crankshaft 18. A crank gear 19 is fastened to the crankshaft 18. A chain 20 is engaged with the crank gear 19. The chain 20 has two surfaces. The surface that comes into contact with the crank gear 19 is hereinafter referred to as the "front surface," and the opposite surface is hereinafter referred to as the "back surface."

The front surface of the chain 20 is also engaged with the left-hand intake drive gear 12 and right-hand exhaust drive gear 17. Therefore, the left-hand intake camshaft 10 and right-hand exhaust camshaft 15 are driven by the chain 20 to rotate in the same direction as the crankshaft 18. The V-type internal combustion engine also includes an idler gear 21, which absorbs the looseness of the chain 20. The idler gear 21 comes into contact with the back surface of the chain 20 in order to apply an appropriate tension to the chain 20. Since being brought into contact with the back surface of the chain 20, the idler gear 21 rotates in a direction opposite to the direction in which the chain 20, that is, the crankshaft 18, rotates.

The left-hand intake drive gear 12 includes two sets of gear teeth, which are arranged in axial direction. The chain 20 is engaged with one of the two sets of gear teeth. An inter-cam chain 22 is engaged with the remaining set of gear teeth. The inter-cam chain 22 is also engaged with the left-hand exhaust driven gear 13. The inter-cam chain 22 operates so that the torque transmitted to the left-hand intake drive gear 12 by the chain 20 is further transmitted to the left-hand exhaust driven gear 13. As a result, the left-hand intake camshaft 10 and left-hand exhaust camshaft 11 rotate in the same direction in the left-hand bank.

The right-hand exhaust drive gear 17 includes the gear teeth for engagement with the right-hand intake driven gear 16 in addition to the gear teeth for engagement with the chain 20. In other words, the V-type internal combustion engine according to the present embodiment operates so that, in the right-hand bank, the torque transmitted to the right-hand exhaust drive gear 17 by the chain 20 is transmitted to the right-hand intake camshaft 14 by the right-hand intake driven gear 16. Since two sets of gear teeth, which engage with each other, rotate in opposing directions, the right-hand exhaust drive gear 17 and right-hand intake driven gear 16 rotate in opposing directions. In the right-hand bank, therefore, the right-hand intake camshaft 14 and right-hand exhaust camshaft 15 rotate in opposite directions.

In the V-type internal combustion engine according to the present embodiment, the left-hand intake camshaft 10, left-hand exhaust camshaft 11, and right-hand exhaust camshaft 15 rotate in the same direction as the crankshaft 18. Only the right-hand intake camshaft 14 in the right-hand bank rotates in a direction opposite to the direction in which the other camshafts 10, 11, 15 rotate. In other words, in the V-type internal combustion engine, the intake camshafts in the left- and right-hand banks, that is, the left-hand intake camshaft 10 and right-hand intake camshaft 14, rotate in opposite directions.

Figure 2:
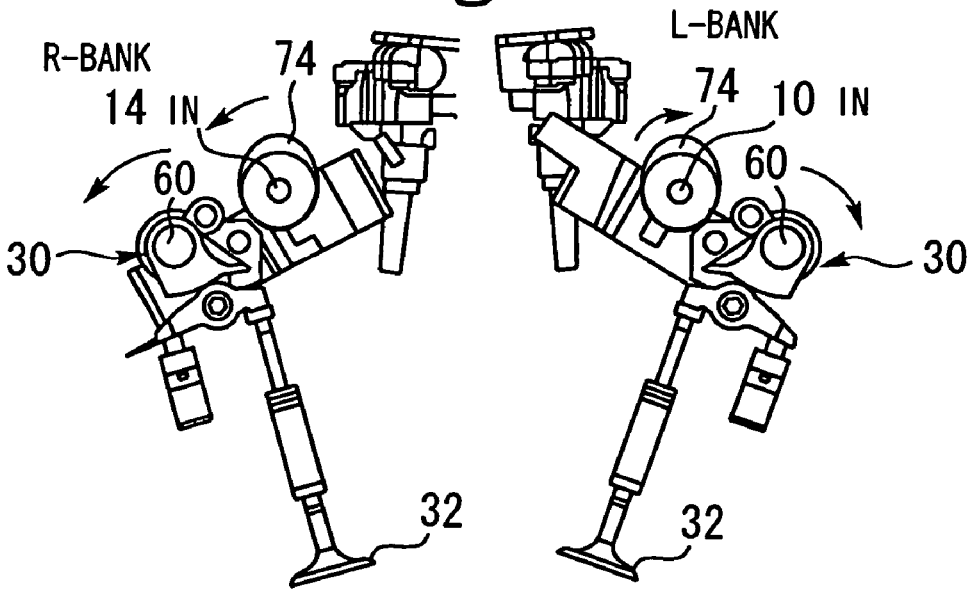
FIG. 2 illustrates right- and left-hand intake camshaft sections of a V-type internal combustion engine according to the first embodiment of the present invention.

FIG. 2 illustrates right- and left-hand intake camshaft sections of the V-type internal combustion engine. In the left- and right-hand banks, a variable valve mechanism 30 and a valve body 32 (intake valve in the current example) are provided for each of the left-hand intake camshaft 10 and right-hand intake camshaft 14, as shown in FIG. 2.

Cams 74 are fastened to the left-hand intake camshaft 10 and right-hand intake camshaft 14 in such a manner that they are associated with a plurality of respective cylinders provided in the left- and right-hand banks. As is the case with the cam 74, the variable valve mechanism 30 and valve body 32 are provided for each cylinder in each bank.

The variable valve mechanism 30 is a mechanism for transmitting the pushing pressure of the cam 74 to the valve body 32. It is capable of varying the period during which the valve body 32 is not closed (hereinafter referred to as the "operating angle") and the amount of lift provided for the valve body 32. More specifically, the variable valve mechanism 30 includes a control shaft 60 for changing the valve opening characteristic of the valve body 32. When the rotation position of the control shaft 60 varies, the operating angle and lift amount of the valve body 32 vary.

The V-type internal combustion engine is configured so that the right- and left-hand banks satisfy a relationship of a mirror arrangement. Therefore, the variable valve mechanisms 30 also provided to the right- and left-hand banks so as to satisfy the relationship of a mirror arrangement. Further, the present embodiment is configured so that the control shafts 60 for the variable valve mechanisms 30 are controlled in symmetrical directions in the right- and left-hand banks. In addition, the present embodiment is configured so that the left-hand intake camshaft 10 and right-hand intake camshaft 14 rotate in opposite directions as described earlier. Consequently, in the V-type internal combustion engine according to the present embodiment, there is satisfied the relationship of a mirror arrangement, that is, of a left-right symmetry, for all intake valve (valve body 32) drive mechanism components even including the shaft rotation directions.

[Details of Variable Valve Mechanism Configuration]

The configuration and operation of the variable valve mechanism 30 will now be described in detail. In the V-type internal combustion engine according to the present embodiment, two intake valves are provided for each cylinder. It is therefore assumed that the variable valve mechanism 30, which is provided for each cylinder, drives two intake valves.

Figure 3:
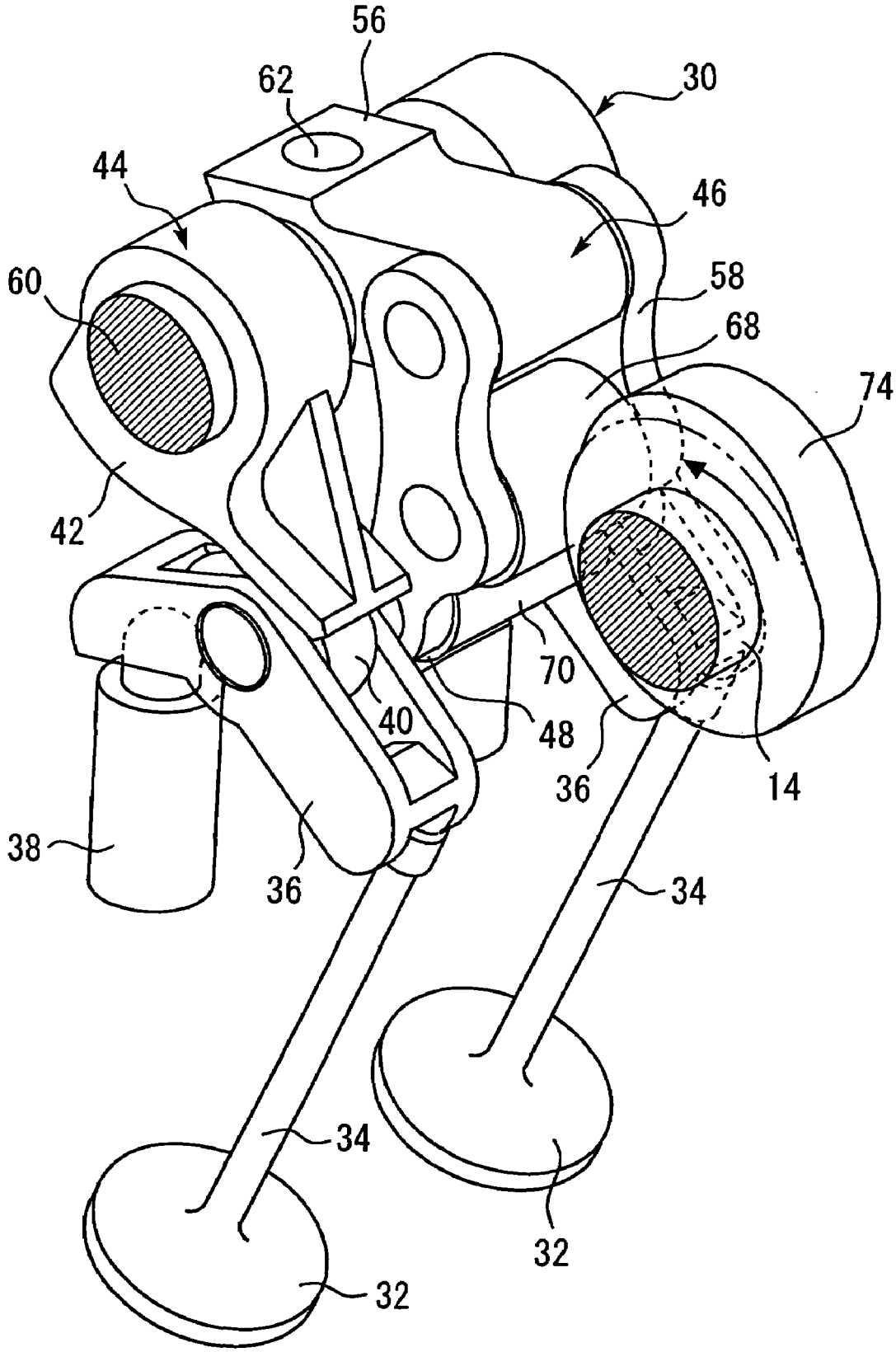
FIG. 3 is a perspective view illustrating the details of the variable valve mechanism according to the first embodiment of the present invention.

FIG. 3 is a perspective view illustrating the essential parts of the variable valve mechanism 30. The configuration of the variable valve mechanism 30 in the left-hand bank is the same as that of the variable valve mechanism 30 in the right-hand bank. It is therefore assumed for explanation purposes that the variable valve mechanism 30 mounted in the right-hand bank is shown in FIG. 3 and positioned near the right-hand intake camshaft 14.

The variable valve mechanism 30 is joined to two valve bodies 32 (intake valves in the current example) to be driven. A valve stem 34 is fastened to each valve body 32. The end of the valve stem 34 is in contact with one end of a rocker arm 36. The valve stem 34 is pressed by a valve spring (not shown in FIG. 3). The valve stem 34, which is pressed by the valve spring, pushes one end of the rocker arm 36 upward. The other end of the rocker arm 36 is supported by a hydraulic lash adjuster 38 so that the rocker arm 36 can turn. The hydraulic lash adjuster 38 can automatically adjust a tappet clearance while automatically adjusting the vertical position of the rocker arm by means of hydraulic pressure.

A roller 40 is positioned at the central part of the rocker arm 36. A swing arm 42 is positioned over the roller 40. The configuration around the swing arm 42 will now be described with reference to FIG. 4.

Figure 4:
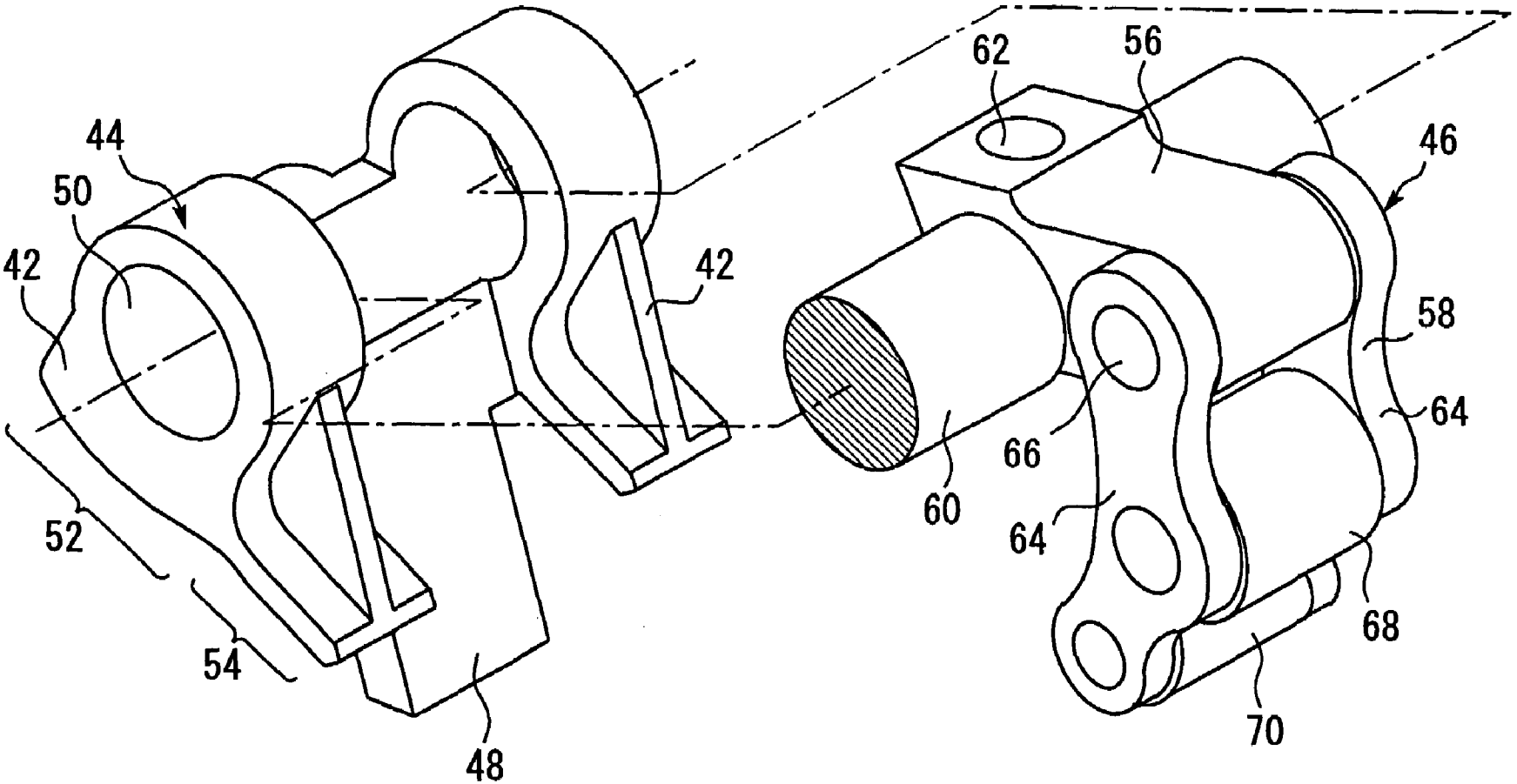
FIG. 4 is an exploded perspective view illustrating a first arm member and second arm member, which are the components of the variable valve mechanism shown in FIG. 3.

FIG. 4 is an exploded perspective view illustrating a first arm member 44 and a second arm member 46. The first arm member 44 and second arm member 46 are major component members of the variable valve mechanism 30, which is shown in FIG. 3. The aforementioned swing arm 42 is part of the first arm member 44 as indicated in FIG. 4.

As shown in FIG. 4, the first arm member 44 incorporates two swing arms 42 and a roller contact plane 48, which is sandwiched between the two swing arms 42. The two swing arms 42 are provided respectively for the two valve bodies 32 and in contact with the aforementioned roller 40 (see FIG. 3).

The first arm member 44 is equipped with a bearing section 50. The bearing section 50 has an opening, which goes through the two swing arms. Each swing arm 42 has a concentric circular section 52 and a pushing pressure section 54, which are mounted on a surface that is in contact with the roller 40. The concentric circular section 52 is positioned so that the surface in contact with the roller 40 is concentric with the bearing section 50. The pushing pressure section 54 is configured so that the distance between the center of the bearing section 50 and a point thereon becomes longer as the point becomes closer to its leading end.

The second arm member 46 is equipped with a nonswing section 56 and a swing roller section 58. The nonswing section 56 is provided with a through-hole. The control shaft 60, which is described with reference to FIG. 2, is inserted into the through-hole. Further, a retaining pin 62 is inserted into the nonswing section 56 and control shaft 60 in order to lock the positional relationship between the nonswing section 56 and control shaft 60. Therefore, the nonswing section 56 and control shaft 60 function as a one solid piece.

The swing roller section 58 is provided with two sidewalls 64. The sidewalls 64 are joined to the nonswing section 56 via the rotation shaft 66 so that the sidewalls 64 freely turn. A cam contact roller 68 and a slide roller 70 are positioned between the two sidewalls 64. The cam contact roller 68 and slide roller 70 can freely turn while they are sandwiched between the sidewalls 64.

The aforementioned control shaft 60 is retained for rotation by the bearing section 50 of the first arm member 44. In other words, the control shaft 60 should be integral with the nonswing section 56 while it is retained by the bearing section 50. To meet such a requirement, the nonswing section 56 (that is, the second arm member 46) is positioned between the two swing arms 42 of the first arm member 44 before being secured to the control shaft 60. With such positioning achieved, the control shaft 60 is inserted so as to pass through the two bearing sections 50 and nonswing section 56. Subsequently, the retaining pin 62 is set so as to secure the control shaft 12 and nonswing section 56. As a result, a mechanism is realized in which the first arm member 44 can freely turn about the control shaft 60, the nonswing section 56 is integral with the control shaft 60, and the swing roller section 58 can swing in relation to the nonswing section 56.

When the first arm member 44 and second arm member 46 are assembled as described above and predefined conditions are met by the relative angle between the first arm member 44 and control shaft 60, that is, the relative angle between the first arm member 44 and nonswing section 56, the slide roller 70 of the swing roller section 58 can come into contact with the roller contact plane 48 of the first arm member 44. When the first arm member 44 turns on the control shaft 60 within a range within which the predefined conditions are met while the slide roller 70 of the swing roller section 58 is in contact with the roller contact plane 48 of the first arm member 44, the slide roller 70 can roll along the roller contact plane 48. The variable valve mechanism according to the present embodiment opens/closes the valve body 32 in accordance with the roll of the slide roller 70. The operation of the valve body 32 will be described in detail later with reference to FIGS. 5A, 5B, 6A, and 6B.

FIG. 3 shows the first arm member 44, second arm member 46, and control shaft 60 that are assembled together as described above. In such an assembled state, the positions of the first arm member 44 and second arm member 46 are regulated by the rotation position of the control shaft 60. A motor is coupled to the control shaft 60 via a gear mechanism (not shown). In the state shown in FIG. 3, the rotation angle of the control shaft 60 is adjusted by the motor so that the slide roller 70 may be brought into contact with the roller contact plane 48.

As shown in FIG. 3, the variable valve mechanism 30 is positioned near the right-hand intake camshaft 14. More specifically, the variable valve mechanism 30 is positioned so that the cam contact roller 68 of the swing roller 58 comes into contact with the cam 74 fastened to the right-hand intake camshaft 14. While this configuration is employed, the upward motion of the cam contact roller 68 is regulated by the cam 74. Therefore, when the cam nose begins to come into contact with the cam contact roller 68 as the cam 74 rotates, the cam contact roller 68 is pushed downward by the resulting pushing pressure. The resulting pushing pressure is transmitted to the roller contact plane 48 of the first arm member 44 via the slide roller 70.

In other words, in the state shown in FIG. 3, the cam 74 continues to be in mechanical contact with the first arm member 44 via the swing roller section 58. While rolling over the roller contact plane 48, the slide roller 70 can continuously transmit the pushing pressure generated by the cam 74 to the first arm member 44. As a result, the first arm member 44 rotates around the control shaft 60, thereby causing the swing arm 42 to depress the rocker arm 36 and moving the valve body 32 in the valve opening direction. The variable valve mechanism 30 operates as described above to open/close the valve body 32 in synchronism with the rotation of the cam 74.

[Variable Valve Mechanism Operation]

The operation of the variable valve mechanism 30 will now be described with reference to FIGS. 5A, 5B, 6A, and 6B. In FIGS. 5A, 5B, 6A, and 6B, a lost motion spring 76 and a valve spring 78 are shown in addition to the aforementioned components. The valve spring 78 pushes the valve stem 34 and rocker arm 36 in the valve closing direction. The lost motion spring 76, on the other hand, maintains mechanical contact between the roller contact plane 48 and cam 74.

As described above, the variable valve mechanism 30 drives the valve body 32 by mechanically transmitting the force of the cam 74 to the roller contact plane 48. For proper operation of the variable valve mechanism 30, it is therefore necessary that the cam 74 be mechanically coupled to the roller contact plane 48 at all times via the cam contact roller 68 and slide roller 70. To meet this requirement, it is necessary that the roller contact plane 48, that is, the first arm member 44, be pushed toward the cam 74.

The lost motion spring 76 for use in the present embodiment is installed so that its upper end is fastened, for instance, to the cylinder head with the lower end positioned to push the rear end of the roller contact plane 48. The pushing force works so that the roller contact plane 48 pushes the slide roller 70 upward. Further, the pushing force also works to press the cam contact roller 68 against the cam 74. As a result, the variable valve mechanism 30 ensures that the cam 74 is mechanically coupled to the roller contact plane 48.

Figure 5B:
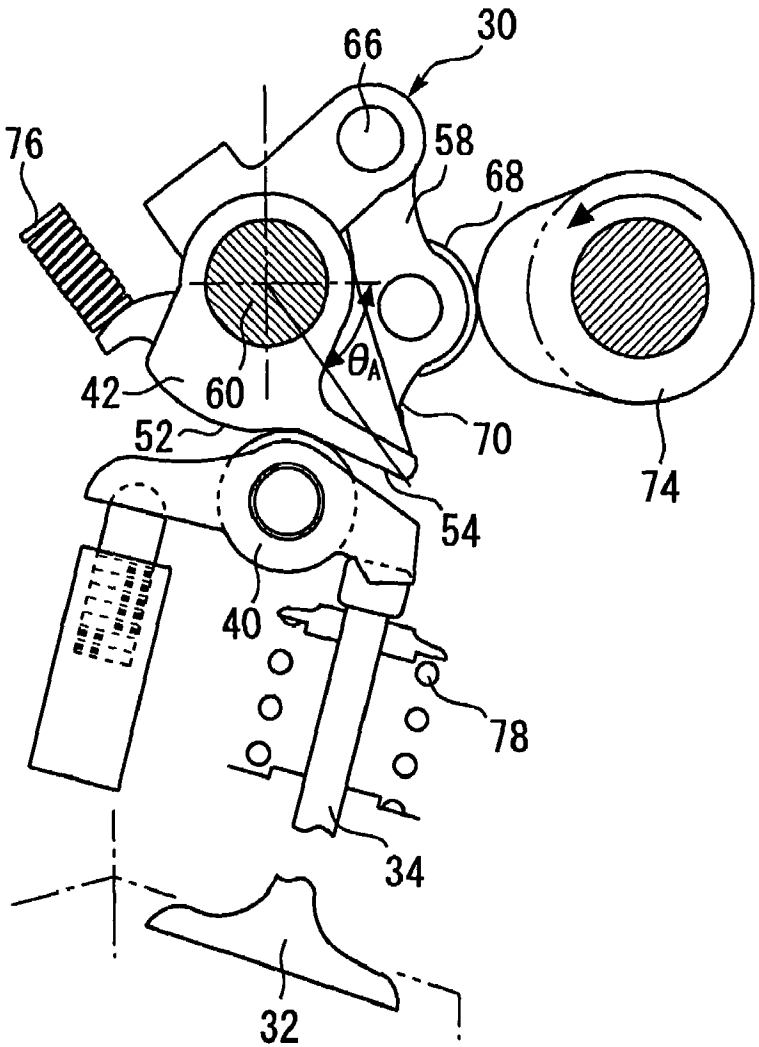
FIGS. 5A and 5B illustrate a small lift operation that is performed by the variable valve mechanism according to the first embodiment of the present invention.
Figure 5A:
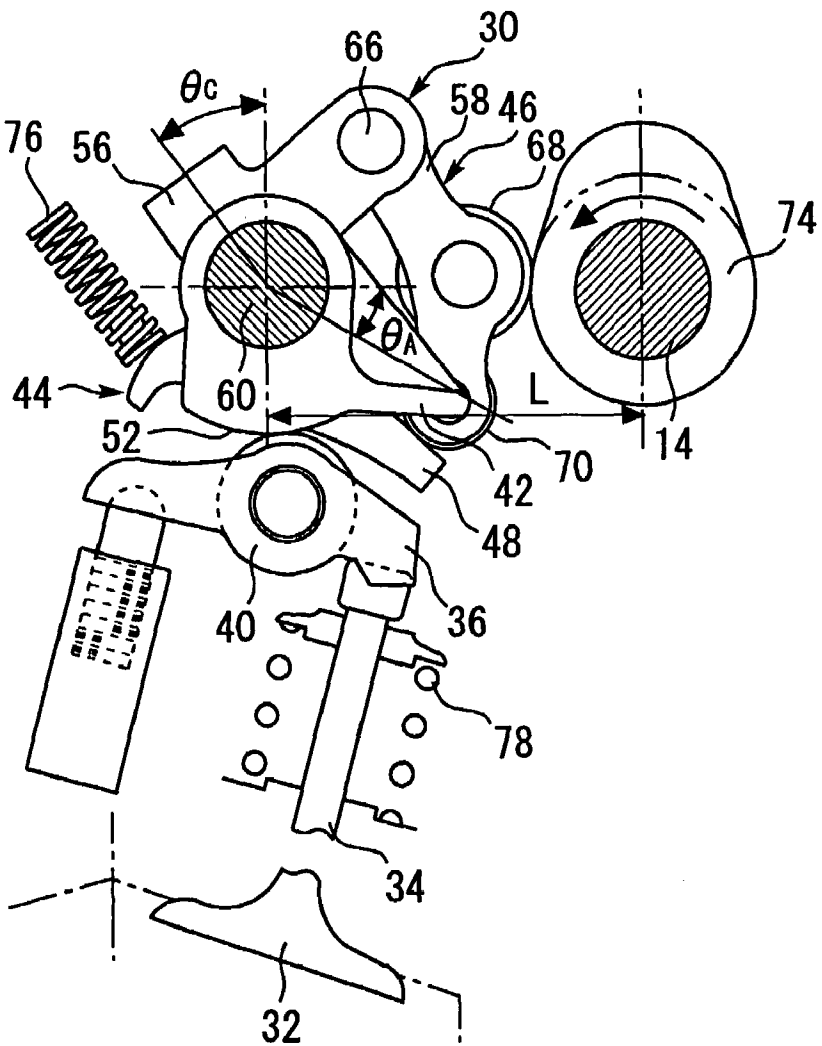

FIGS. 5A and 5B show that the variable valve mechanism 30 operates to give a small lift to the valve body 32. This operation is hereinafter referred to as a "small lift operation." More specifically, FIG. 5A indicates that the valve body 32 is closed during a small lift operation, whereas FIG. 5B indicates that the valve body 32 is open during a small lift operation.

In FIG. 5A, the symbol $\theta_c$ denotes a parameter that indicates the rotation position of the control shaft 60. The parameter is hereinafter referred to as the "control shaft rotation angle $\theta_c$." For the sake of convenience, the control shaft rotation angle $\theta_c$ is defined herein as the angle between the vertical direction and the axial direction of the retaining pin 62 that secures the control shaft 60 and nonswing section 56. The symbol $\theta_A$ in FIG. 5A denotes a parameter that indicates the rotation position of the swing arm 42. This parameter is hereinafter referred to as the "arm rotation angle $\theta_A$." For the sake of convenience, the arm rotation angle $\theta_A$ is defined herein as the angle between the horizontal direction and the straight line connecting the leading end of the swing arm 42 to the center of the control shaft 60.

In the variable valve mechanism 30, the rotation position of the swing arm 42, that is, the arm rotation angle $\theta_A$, is determined by the position of the slide roller 70. The position of the slide roller 70 is determined by the position of the rotation shaft 66 for the swing roller section 58 and the position of the cam contact roller 68. Within the range within which the contact between the cam contact roller 68 and cam 74 is maintained, the greater the degree of counterclockwise rotation of the rotation shaft 66 in FIGS. 5A and 5B, that is, the greater the control shaft rotation angle $\theta_c$, the higher the position of the slide roller 70. In the variable valve mechanism 30, therefore, the greater the control shaft rotation angle $\theta_c$, the smaller the arm rotation angle $\theta_A$.

In a state shown in FIG. 5A, the control shaft rotation angle $\theta_c$ is virtually maximized within the range within which the cam contact roller 68 can maintain its contact with the cam 74, that is, the cam 74 can regulate the upward movement of the cam contact roller 68. Therefore, the arm rotation angle $\theta_A$ is virtually minimized in the state shown in FIG. 5A. In this instance, the variable valve mechanism 30 is such that the approximate center of the concentric circular section 52 of the swing arm 42 is in contact with the roller 40 of the rocker arm 36, thereby closing the valve body 32. The arm rotation angle $\theta_A$ prevailing in this instance is hereinafter referred to as the "reference arm rotation angle $\theta_{AO}$" for a small lift.

When the cam 74 rotates in the state shown in FIG. 5A, the cam contact roller 68 moves toward the control shaft 60 as it is pressed by the cam nose. Since the distance between the rotation shaft 66 of the swing roller section 58 and the slide roller 70 remains unchanged, the roller contact plane 48 is depressed by the slide roller 68, which rolls over the roller contact plane 48, when the cam contact roller 68 approaches the control shaft 60. Consequently, the swing arm 42 rotates in such a direction as to increase the arm rotation angle $\theta_A$. As a result, the contact point between the swing arm 42 and roller 40 leaves the approximate center of the concentric circular section 52 and moves toward the pushing pressure section 54.

When the pushing pressure section 54 comes into contact with the roller 40 due to the rotation of the swing arm 42, the valve body 32 moves in the valve opening direction against the force applied by the valve spring 78. When the peak of the cam nose comes into contact with the cam contact roller 68 as shown in FIG. 5B, the arm rotation angle $\theta_A$ becomes maximized (this angle is hereinafter referred to as the "maximum arm rotation angle $\theta_{AMAX}$"). Consequently, the lift amount for the valve body 32 reaches its maximum. Subsequently, when the cam 74 rotates to decrease the arm rotation angle $\theta_A$, the lift amount for the valve body 32 decreases. When the contact point between the roller 40 and swing arm 42 returns to the concentric circular section 52, the valve body 32 closes.

Since the reference arm rotation angle $\theta_{AO}$ for a small lift operation is small, the valve body 32 remains closed for a certain period of time after the cam nose begins to come into contact with the cam contact roller 68. After the maximum lift amount is generated, the valve body 32 reverts to a closed state relatively early before the end of cam nose pressure application to the cam contact roller 68. As a result, when a small lift operation is performed, the operating angle of the valve body 32 is small while the valve body 32 is in a non-closed state. The maximum lift amount for the valve body 32 is also rendered small.

Figure 6B:
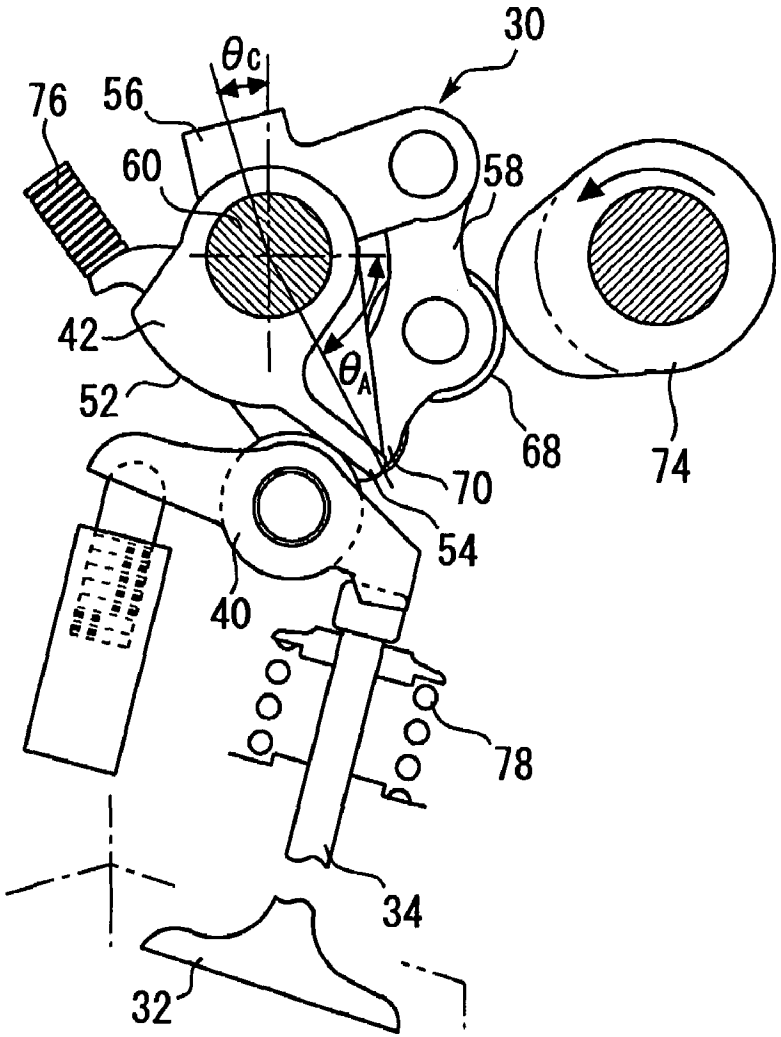
FIGS. 6A and 6B illustrate a great lift operation that is performed by the variable valve mechanism according to the first embodiment of the present invention.
Figure 6A:
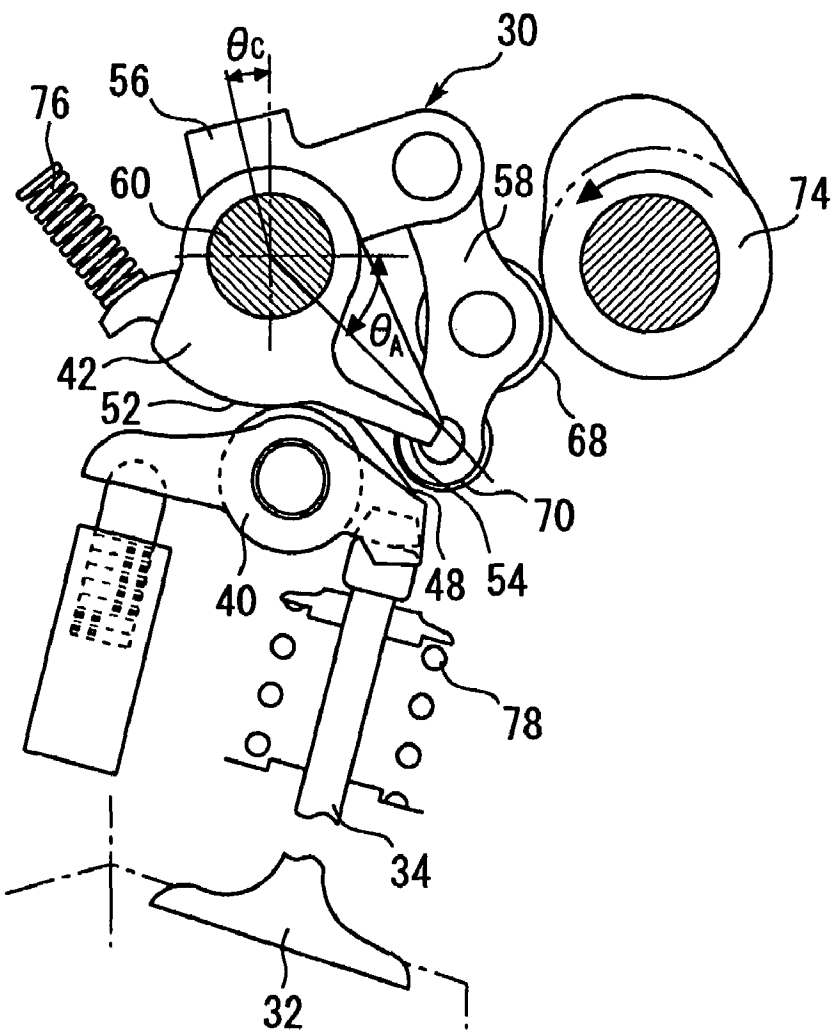

FIGS. 6A and 6B indicate that the variable valve mechanism 30 operates to give a great lift to the valve body 32. This operation is hereinafter referred to as a "great lift operation." More specifically, FIG. 6A indicates that the valve body 32 is closed during a great lift operation, whereas FIG. 6B indicates that the valve body 32 is open during a great lift operation.

When a great lift operation is to be performed, the control shaft rotation angle $\theta_c$ is adjusted to a sufficiently small value as shown in FIG. 6A. As a result, the arm rotation angle $\theta_A$ in a non-lift state, that is, the reference arm rotation angle $\theta_{AO}$, is set to a sufficiently great value to such an extent that the slide roller 70 does not fall away from the roller contact section 48. The variable valve mechanism 30 is configured so that the contact point between the swing arm 42 and roller 40 is positioned at the end of the concentric circular section 52 at the above reference arm rotation angle $\theta_{AO}$. In such a situation, therefore, the valve body 32 remains closed.

When the cam 74 rotates in a state shown in FIG. 6A, the contact point between the roller 40 and swing arm 42 moves from the concentric circular section 52 to the pushing pressure section 54 immediately after the cam contact roller 68 begins to be pressed by the cam nose. The valve body 32 is then greatly pushed in the valve opening direction until the cam contact roller 68 is pressed by the peak section of the can nose. Even after the lift amount for the valve body 32 is maximized as shown in FIG. 6B, the valve body 32 remains open for a long period of time as far as the cam contact roller 68 is pressed by the cam nose. Therefore, while the great lift operation is being performed as described above, the variable valve mechanism 30 can provide the valve body 32 with a great operating angle and large lift amount.

[Variable Valve Mechanism Phase Coupling]

As described above, the variable valve mechanism 30 can decrease the operating angle and lift amount of the valve body 32 by rotating the control shaft 60 in such a manner as to decrease the reference arm rotation angle $\theta_{AO}$, and increase the operating angle and lift amount of the valve body 32 by rotating the control shaft 60 in such a manner as to increase the reference arm rotation angle $\theta_{AO}$ Therefore, the V-type internal combustion engine according to the present embodiment can accurately control the amount of intake air by controlling the rotation position of the control shaft 60 in such a manner as to give a desired operating angle and lift amount to the valve body 32 (intake valve).

Meanwhile, the right-hand intake camshaft 14, which faces the variable valve mechanism 30 in the right-hand bank, rotates so that the nose of the cam 74 passes from top to bottom (see FIGS. 5A, 5B, 6A, and 6B) as viewed from the cam contact roller 68. Therefore, when the reference arm rotation angle decreases to move the cam contact roller 68 upward, the timing with which the nose of the cam 74 begins to come into contact with the cam contact roller 68 advances. As a result, the variable valve mechanism 30 in the right-hand bank characteristically advances the valve opening phase when the control shaft 60 is controlled in the small operating angle direction.

Figure 7:
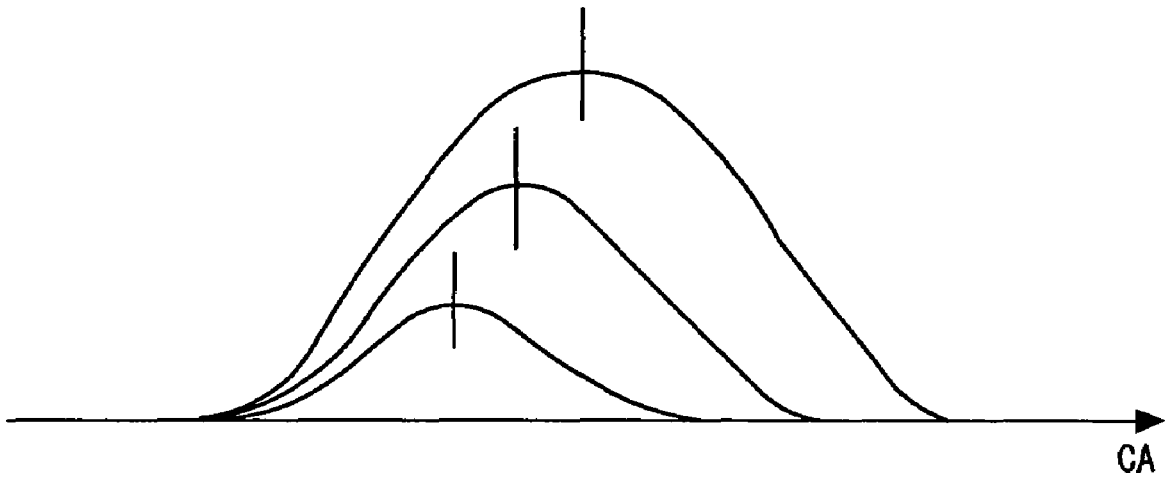
FIG. 7 illustrates how phase coupling occurs in the variable valve mechanism according to the first embodiment of the present invention.

FIG. 7 illustrates phase coupling, which occurs due to the above-mentioned characteristic. More specifically, as is obvious from FIG. 7, the variable valve mechanism 30 in the right-hand bank performs phase coupling by advancing the valve opening phase of the valve body 32 when the operating angle (lift amount) of the valve body 32 decreases, and by retarding the valve opening phase of the valve body 32 when the operating angle (lift amount) of the valve body 32 increases. In this instance, the valve closing timing of the valve body 32 can be greatly changed by changing the operating angle and lift amount and without significantly changing the valve opening timing of the valve body 32.

In a non-throttle type internal combustion engine, the intake valve closing timing is more sensitive to the cylinder intake air amount than the intake valve opening timing. To enhance the intake air amount control accuracy, therefore, it is required that an operating angle change be greatly reflected in the intake valve closing timing. The variable valve mechanism 30 in the right-hand bank meets the requirement because it provides phase coupling as indicated in FIG. 7. Consequently, the variable valve mechanism 30 in the right-hand bank can exercise intake air amount control with high accuracy.

[Mirror Arrangement of the Variable Valve Mechanisms in the Right- and Left-Hand Banks]

The variable valve mechanisms 30 are mounted in the right- and left-hand banks of the V-type internal combustion engine according to the present embodiment in such a manner as to form a mirror arrangement. As described with reference to FIGS. 3 and 4, the variable valve mechanisms 30 have a left-right symmetrical configuration. Since the variable valve mechanisms 30 have such a configuration, they can be mounted in the right- and left-hand banks in such a manner as to form a mirror arrangement while all their parts are identical with each other. Therefore, the variable valve mechanisms according to the present embodiment bring benefits due to parts commonality.

In the V-type internal combustion engine according to the present embodiment in which the variable valve mechanisms 30 are configured to form a mirror arrangement, the rotations of the control shafts 60 in the right- and left-hand banks can be controlled in symmetrical directions, that is, in opposite directions. When the control shafts 60 are controlled in this manner, the reference arm rotation angles $\theta_{AO}$ in the right- and left-hand banks increase/decrease in the same manner. Consequently, it is possible to increase/decrease the operating angles and lift amounts of the valve bodies 32 in the same manner.

In the V-type internal combustion engine according to the present embodiment, the intake camshafts 10, 14 in the right- and left-hand banks rotate in opposite directions (see FIG. 2). Therefore, the right- and left-hand intake camshafts 10, 14 rotate in such a manner that the nose of the cam 74 passes from top to bottom as viewed from the variable valve mechanism 30 regardless to the mirror arrangement of the variable valve mechanisms 30. Consequently, when the reference arm rotation angle $\theta_{AO}$ decreases, the timing with which the nose of the cam 74 begins to come into contact with the cam contact roller 68 advances in both banks.

If the right-hand intake camshaft 14 rotates in the same direction as the left-hand intake camshaft 10 (in a clockwise direction in FIGS. 5A, 5B, 6A, and 6B), the timing with which the nose of the cam 74 begins to come into contact with the cam contact roller 68 in the right-hand bank retards with a decrease in the reference arm rotation angle $\theta_{AO}$. In this instance, phase coupling occurs in a direction opposite to the direction shown in FIG. 7, that is, the valve opening phase of the valve body 32 retards with a decrease in the operating angle of the valve body 32. If this phenomenon occurs in the right-hand bank, the intake air mount can be accurately controlled in the left-hand bank. In the right-hand bank, however, such intake air amount control cannot be exercised.

In the V-type internal combustion engine according to the present embodiment, however, the right- and left-hand intake camshafts 10, 14 rotate in opposite directions. Therefore, phase coupling occurs in both banks as indicated in FIG. 7. Consequently, when the configuration according to the present embodiment is employed, it is possible to exercise intake air amount control with high accuracy in both banks while permitting the variable valve mechanisms 30 in the right- and left-hand banks to use the same parts.

In the first embodiment, which has been described above, the valve bodies 32, which constitute intake valves, correspond to the "valve bodies of the same type" according to the first aspect of the present invention; the right- and left-hand banks correspond to the "first bank and second bank"; "the left-hand intake camshaft 10 and right-hand intake camshaft 14 correspond to the "first camshaft and second camshaft" according to the first aspect of the present invention; and the crank gear 19, left-hand intake drive gear 12, right-hand exhaust drive gear 17, right-hand intake driven gear 16, and chain 20 correspond to the "camshaft drive mechanism" according to the first aspect of the present invention.

Further, in the first embodiment, which has been described above, the crank gear 19, left-hand intake drive gear 12, right-hand exhaust drive gear 17, and chain 20 correspond to the "power transmission mechanism" according to the second aspect of the present invention; the right-hand exhaust drive gear 17 and right-hand intake driven gear 16 correspond to the "gear mechanism" according to the second aspect of the present invention; and the right-hand intake driven gear 16 corresponds to the "rotation transmission mechanism" according to the second aspect of the present invention.

Second Embodiment

Figure 8A:
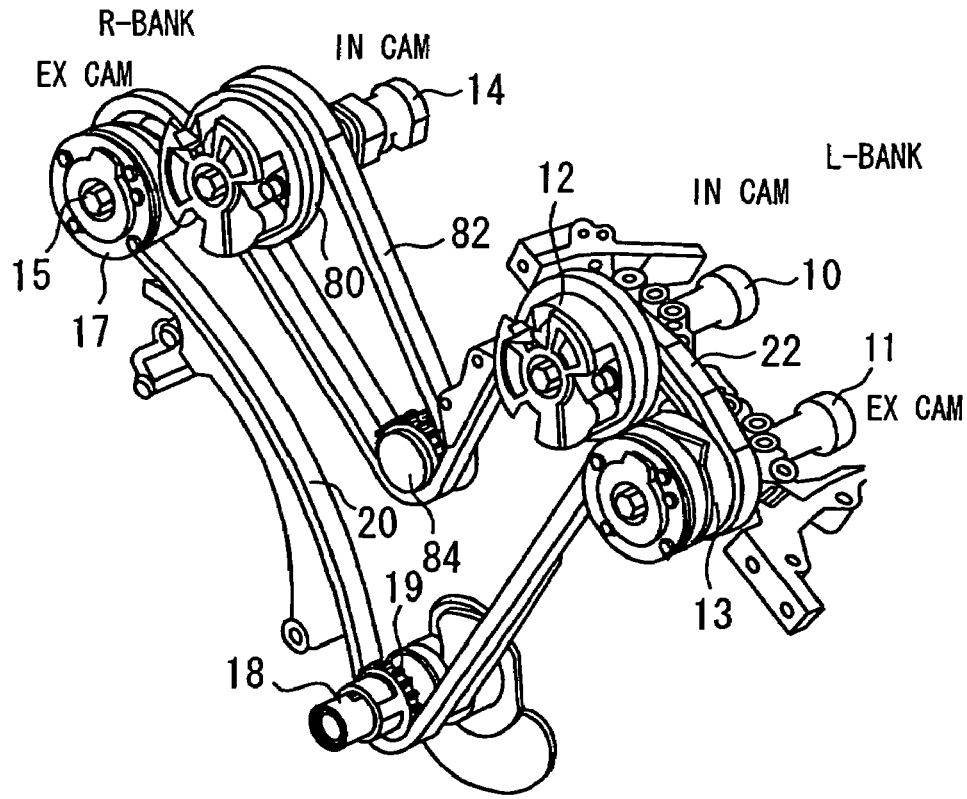
FIGS. 8A and 8B are a perspective view and a front view, respectively, illustrating the overall configuration of a variable valve mechanism according to a second embodiment of the present invention.
Figure 8B:
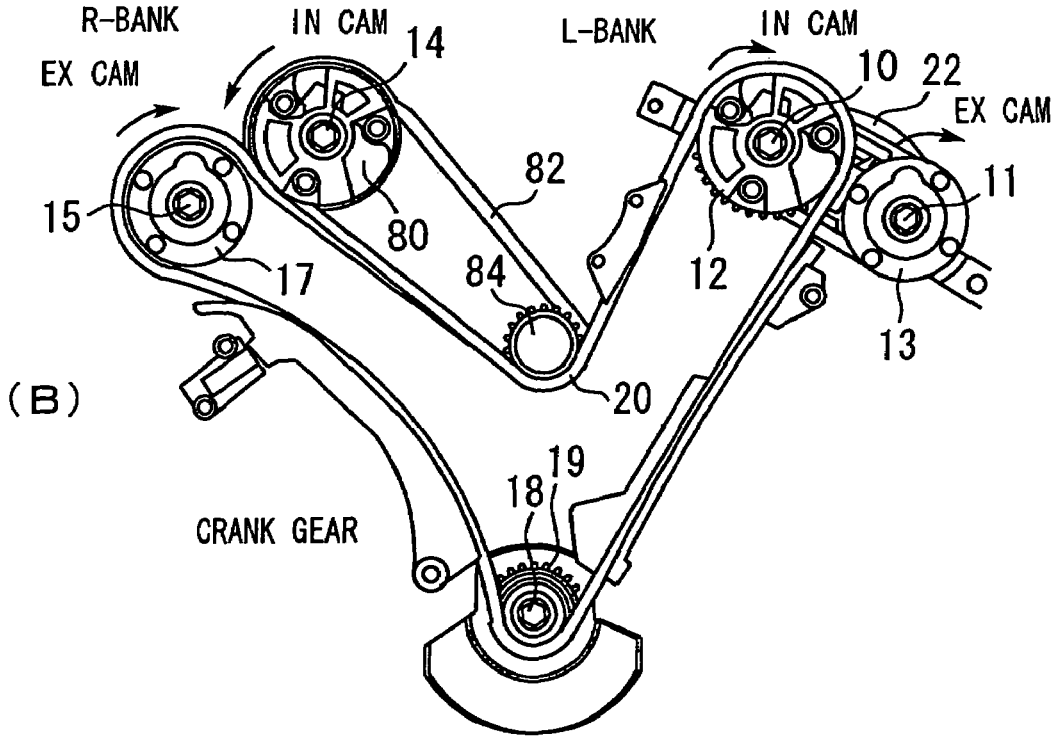

A second embodiment of the present invention will now be described with reference to FIGS. 8A and 8B. FIG. 8A is a perspective view illustrating the overall configuration of a variable valve mechanism according to the second embodiment of the present invention. FIG. 8B is a front view illustrating the variable valve mechanism. Like elements in FIGS. 1, 8A, and 8B are assigned the same reference numerals and will be omitted from the subsequent description or briefly described.

The variable valve mechanism according to the present embodiment is the same as the variable valve mechanism according to the first embodiment except that a different mechanism is used to rotate the intake camshaft 14 in the right-hand bank (right-hand intake camshaft 14). More specifically, a right-hand intake driven gear 80 is fastened to the right-hand intake camshaft 14 for use in the present embodiment, and a right-hand intake cam drive chain 82 is engaged with the right-hand intake driven gear 80.

In the present embodiment, the idler gear 84 for eliminating any looseness in the chain 20 has two sets of gear teeth. One of the two sets of gear teeth is in contact with the back surface of the chain 20. The above-mentioned right-hand intake cam drive chain 82 is installed over the other set of gear teeth.

When the configuration described above is employed, the right-hand intake cam drive chain 82 can transmit the rotation of the idler gear 84 to the right-hand intake driven gear 80. The idler gear 84 rotates in a direction opposite to the direction in which the crankshaft 18 rotates because the idler gear 84 is in contact with the back surface of the chain 20. As is the case with the variable valve mechanism according to the first embodiment, the variable valve mechanism according to the present embodiment can rotate the right-hand intake camshaft 14 in a direction opposite to the direction in which the left-hand intake camshaft 10 rotates.

In the present embodiment, too, the variable valve mechanisms 30 are mounted in the right- and left-hand banks in such a manner as to form a mirror arrangement. When the right- and left-hand intake camshafts 10, 14 rotate in opposite directions in the above situation, phase coupling occurs in both the right- and left-hand banks as indicated in FIG. 7. Therefore, the variable valve mechanism according to the present embodiment can provide the same advantages as the variable valve mechanism according to the first embodiment.

In the second embodiment, which has been described above, the crank gear 19, left-hand intake drive gear 12, right-hand exhaust drive gear 17, chain 20, right-hand intake driven gear 80, right-hand intake cam drive chain 82, and idler gear 84 correspond to the "camshaft drive mechanism" according to the first aspect of the present invention.

Further, in the second embodiment, which has been described above, the crank gear 19, left-hand intake drive gear 12, right-hand exhaust drive gear 17, and chain 20 correspond to the "power transmission mechanism according to the third aspect of the present invention; and the right-hand intake driven gear 80 and right-hand intake cam drive chain 82 correspond to the "rotation transmission mechanism" according to the third aspect of the present invention.

Third Embodiment

Figure 9A:
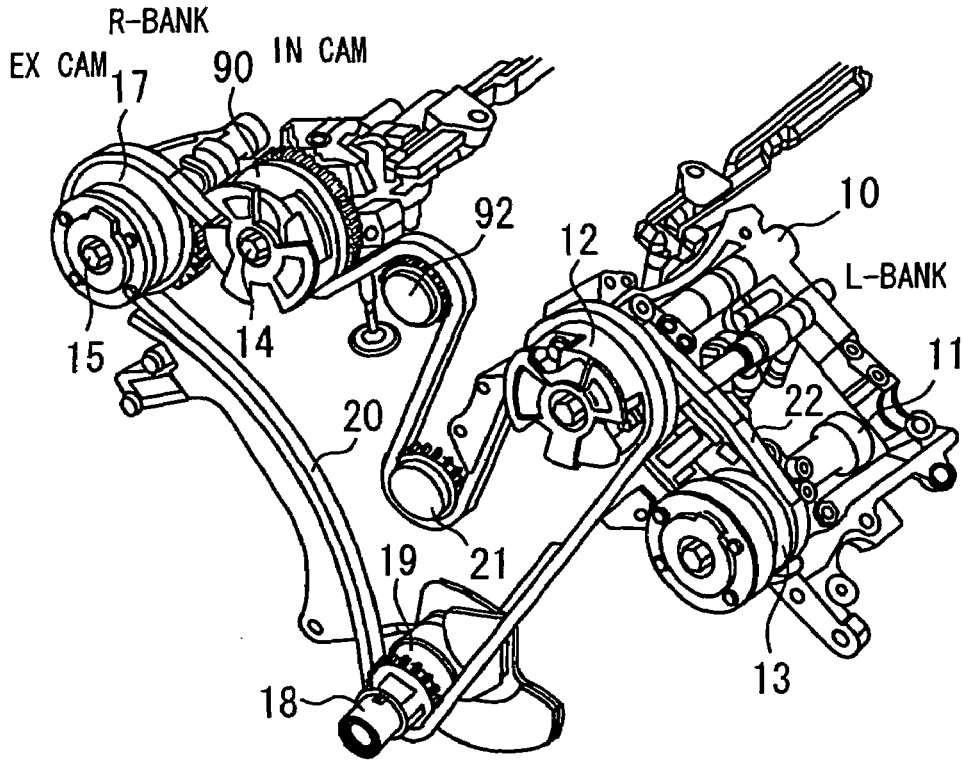
FIGS. 9A and 9B are a perspective view and a front view, respectively, illustrating the overall configuration of a variable valve mechanism according to a third embodiment of the present invention.
Figure 9B:
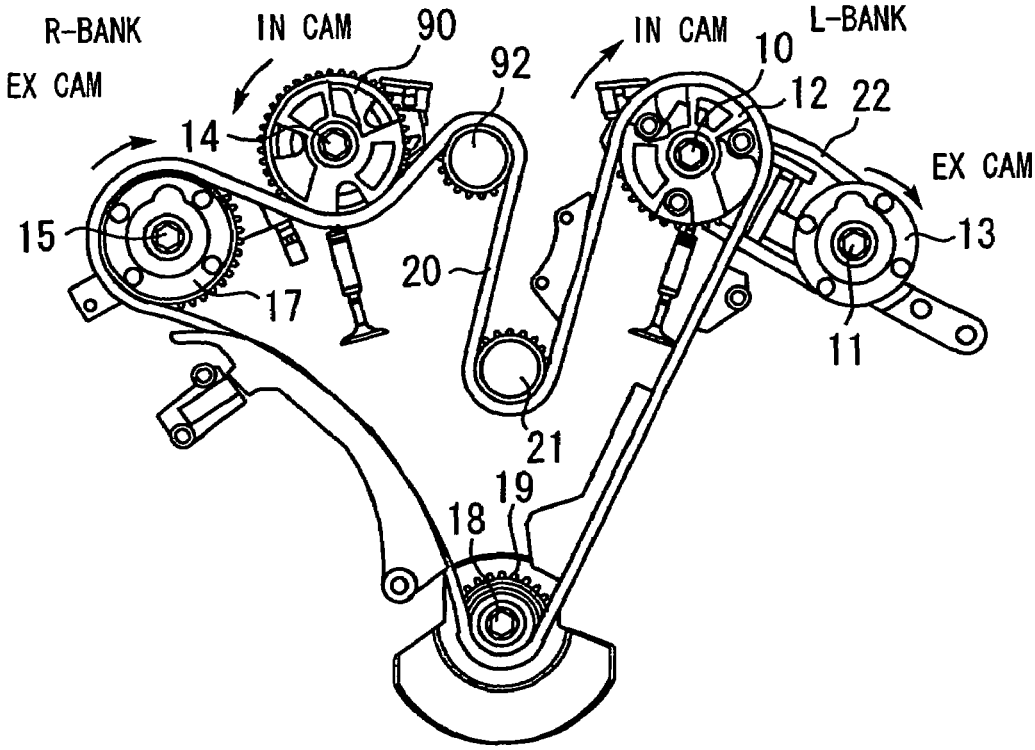

A third embodiment of the present invention will now be described with reference to FIGS. 9A and 9B. FIG. 9A is a perspective view illustrating the overall configuration of a variable valve mechanism according to the third embodiment of the present invention. FIG. 9B is a front view illustrating the variable valve mechanism. Like elements in FIGS. 1, 9A, and 9B are assigned the same reference numerals and will be omitted from the subsequent description or briefly described.

The variable valve mechanism according to the present embodiment is the same as the variable valve mechanism according to the first embodiment except that a different mechanism is used to rotate the intake camshaft 14 in the right-hand bank (right-hand intake camshaft 14). More specifically, a right-hand intake driven gear 90 is fastened to the right-hand intake camshaft 14 in the present embodiment. The right-hand intake driven gear 90 is in contact with the back surface of the chain 20. Further, the V-type internal combustion engine according to the present embodiment includes a second idler gear 92 for pressing the back surface of the chain 20 against the right-hand intake driven gear 90.

When the configuration described above is employed, the chain 20 can transmit the rotation of the crankshaft 18 to the right-hand intake driven gear 90. The right-hand intake driven gear 90 rotates in a direction opposite to the direction in which the crankshaft 18 rotates because the right-hand intake driven gear 90 is in contact with the back surface of the chain 20. As is the case with the variable valve mechanism according to the first embodiment, the variable valve mechanism according to the present embodiment can rotate the right-hand intake camshaft 14 in a direction opposite to the direction in which the left-hand intake camshaft 10 rotates.

In the present embodiment, too, the variable valve mechanisms 30 are mounted in the right- and left-hand banks in such a manner as to form a mirror arrangement. When the right- and left-hand intake camshafts 10, 14 rotate in opposing directions in the above situation, phase coupling occurs in both the right- and left-hand banks as indicated in FIG. 7. Therefore, the variable valve mechanism according to the present embodiment can provide the same advantages as the variable valve mechanism according to the first embodiment.

In the third embodiment, which has been described above, the crank gear 19, left-hand intake drive gear 12, right-hand exhaust drive gear 17, right-hand intake driven gear 90, second idler gear 92, idler gear 21, and chain 20 correspond to the "camshaft drive mechanism" according to the first aspect of the present invention.

Further, in the third embodiment, which has been described above, the left-hand intake drive gear 12 corresponds to the "first intake cam gear" according to the fourth aspect of the -present invention; the right-hand exhaust drive gear 17 corresponds to the "exhaust cam gear" according to the fourth aspect of the present invention; and the right-hand intake driven gear 90 corresponds to the "second intake cam gear" according to the fourth aspect of the present invention.

The first to third embodiments, which have been described above, assume that the left-hand intake camshaft 10 and right-hand exhaust camshaft 15 rotate in the same direction. However, the present invention is not limited to the use of such a configuration. More specifically, the present invention requires that the right- and left-hand intake camshafts 10, 14 rotate in opposite directions. The right- and left-hand exhaust camshafts 11, 15 may rotate in any direction.

Fourth Embodiment

A fourth embodiment will now be described with reference to FIGS. 10A and 10B. FIG. 10A is a perspective view illustrating the overall configuration of a variable valve mechanism according to the fourth embodiment of the present invention. FIG. 10B is an enlarged view illustrating essential parts of the variable valve mechanism. Like elements in FIGS. 1, 10A, and 10B are assigned the same reference numerals and will be omitted from the subsequent description or briefly described.

As indicated in FIG. 10A, the variable valve mechanism according to the present embodiment includes a right-hand intake drive gear 100, which is located in the right-hand bank. The chain 20 is engaged with the right-hand intake drive gear 100 and the left-hand intake drive gear 12, which is located in the left-hand bank. In the system according to the present embodiment, therefore, the right-hand intake drive gear 100 and left-hand intake drive gear 12 rotate in the same direction as the crankshaft 18.

The right-hand intake drive gear 100 is coupled to a right-hand exhaust driven gear 104 via an inter-cam chain 102. The inter-cam chain 102 can directly transmit the rotation of the right-hand intake drive gear 100 to the right-hand exhaust driven gear 104.

The right-hand intake camshaft 14 is fastened to the right-hand intake drive gear 100. The right-hand exhaust camshaft 15 is fastened to the right-hand exhaust driven gear 104. Therefore, the right-hand intake camshaft 14 and right-hand exhaust camshaft 15 rotate in the same direction as the crankshaft 18.

As is the case with the first embodiment, the left-hand drive gear 12 is coupled to the left-hand exhaust driven gear 13 via the inter-cam chain 22. The left-hand exhaust camshaft 11 is fastened to the left-hand exhaust driven gear 13. In the system according to the present embodiment, therefore, the left-hand exhaust camshaft 11 rotates in the same direction as the crankshaft 18.

In the system according to the present embodiment, a reversal mechanism 106 is positioned between the right-hand intake drive gear 12 and right-hand intake camshaft 14. The reversal mechanism 106 transmits the rotation of the right-hand intake drive gear 12 to the right-hand intake camshaft 10 in such a manner that the right-hand intake camshaft 10 rotates in a direction opposite to the direction in which the right-hand intake drive gear 12 rotates. The configuration of the reversal mechanism 106 will now be described with reference to FIG. 10B.

As shown in FIG. 10B, the reversal mechanism 106 includes a first bevel gear 108, a second bevel gear 110, and a third bevel gear 112. The first bevel gear 108 is fastened to the left-hand intake camshaft 10. The second bevel gear 110 is fastened to the left-hand intake drive gear 12 and positioned to face the first bevel gear 108.

The first bevel gear 108 is tapered so that its large diameter is positioned toward the left-hand intake camshaft 10 with its small diameter positioned toward the second bevel gear 110. The tapered surface of the first bevel gear 108 is provided with gear teeth. On the other hand, the second bevel gear 110 is tapered so that its large diameter is positioned toward the left-hand intake drive gear 12 with its small diameter positioned toward the first bevel gear 108. The tapered surface of the second bevel gear 110 is provided with gear teeth.

The third bevel gear 112 is positioned so that its central axis is orthogonal with the central axes of the first and second bevel gears 108, 110. Further, the third bevel gear 112 has gear teeth that are provided on the tapered surface of the third bevel gear 112 to engage with the gear teeth of the first and second bevel gears 108, 110.

The rotation shaft of the third bevel gear 112 is retained by a bearing 114. The bearing 114 not only permits the rotation shaft to rotate but also permits it to slide in its axial direction. The bearing 114 incorporates a spring 116, which applies a pushing force to the third bevel gear 112. The third bevel gear 112 receives the pushing force from the spring 116 to remain in contact with the first and second bevel gears 108, 110.

According to the structure of the aforementioned reversal mechanism 106, the first to third bevel gears 108–112 transmit the rotation of the second bevel gear 110 to the first bevel gear 108 in such a manner that the first bevel gear 108 rotates in a direction opposite to the direction in which the second bevel gear 110 rotates. Therefore, the system according to the present embodiment can rotate the left-hand intake camshaft 10 to rotate in a direction opposite to the direction in which the left-hand intake drive gear 12 rotates.

As described above, the system according to the present embodiment rotates the left-hand intake drive gear 12 in the same direction as the right-hand intake camshaft 14. Therefore, the system according to the present embodiment can rotate the right-hand intake camshaft 14 and left-hand intake camshaft 10 in opposite directions.

The aforementioned spring 116 ensures that the engaging surfaces of the first to third bevel gears 108–112 are in close contact with each other, and sufficiently controls the backlash within the reversal mechanism 116. Therefore, the configuration according to the present embodiment can rotate the right-hand intake camshaft 14 and left-hand intake camshaft 10 in opposite directions while maintaining the same quietness as in the first to third embodiments.

In the present embodiment, too, the variable valve mechanisms 30 are mounted in the right- and left-hand banks in such a manner as to form a mirror arrangement. When the right- and left-hand intake camshafts 10, 14 rotate in opposite directions in the above situation, phase coupling occurs in both the right- and left-hand banks as indicated in FIG. 7. Therefore, the variable valve mechanism according to the present embodiment can provide the same advantages as the variable valve mechanism according to the first embodiment.

In the fourth embodiment, which has been described above, the crank gear 19, left-hand intake drive gear 12, right-hand intake drive gear 100, and reversal mechanism 106 correspond to the "camshaft drive mechanism" according to the first aspect of the present invention.

Further, in the fourth embodiment, which has been described above, the left-hand camshaft 10 corresponds to the "first intake camshaft" according to the fifth aspect of the present invention; the right-hand intake camshaft 14 corresponds to the "second intake camshaft" according to the fifth aspect of the present invention; and the crank gear 19, chain 20, and left-hand intake drive gear 12 correspond to the "power transmission mechanism" according to the fifth aspect of the present invention.

Furthermore, in the fourth embodiment, which has been described above, the spring 116 corresponds to the "backlash buffer mechanism" according to the sixth aspect of the present invention.

In the first to fourth embodiments, which have been described above, the chain 20 is used to implement the camshaft drive mechanism, which ensures that the right- and left-hand intake camshafts 10, 14 rotate in opposing directions and at a speed that is synchronized with the speed of the crankshaft. However, the present invention is not limited to the use of such a configuration. Alternatively, the chain 20 may be replaced with a timing belt. Further, the function of the chain 20 may be exercised by using a gear.

Further, in the first to fourth embodiments, which have been described above, the variable valve mechanisms 30 are positioned as intake valve drive mechanisms to form a mirror arrangement, and the right- and left-hand intake camshafts 10, 14 rotate in opposite directions to satisfy the requirement stemming from the mirror arrangement. However, the present invention is not limited to the use of such a configuration. An alternative is to position the variable valve mechanisms 30 as exhaust valve drive mechanisms to form a mirror arrangement, and rotate the right- and left-hand exhaust camshafts 11, 15 in opposite directions to satisfy the requirement stemming from the mirror arrangement.

The invention claimed is:

1. A variable valve mechanism for use in a V-type internal combustion engine comprising:

a first camshaft and a second camshaft, which are respectively positioned in a first bank and in a second bank to drive valve bodies of the same type;

a first variable valve mechanism and a second variable valve mechanism, which are respectively positioned in the first bank and the second bank so as to satisfy a relationship of a mirror arrangement and transmit a pushing pressure to the valve bodies in the banks in accordance with the rotation of the first camshaft or the second camshaft; and a camshaft drive mechanism for rotating the first camshaft and the second camshaft in opposite directions and at a speed that is synchronized with the speed of a crankshaft, wherein each of the first variable valve mechanism and the second variable valve mechanism includes a mechanism for changing an operating angle of the valve body and a valve opening phase of the valve body in accordance with the status of a control shaft, and a control shaft drive mechanism for controlling the status of the control shaft; and wherein the control shaft drive mechanism included in the first variable valve mechanism and the control shaft drive mechanism included in the second variable valve mechanism control the associated control shafts symmetrically.

2. The variable valve mechanism for use in the V-type internal combustion engine according to claim 1, wherein the first bank and the second bank each includes an intake camshaft for driving an intake valve and an exhaust camshaft for driving an exhaust valve;

wherein the valve bodies of the same type are the intake valves; and wherein the camshaft drive mechanism includes:

a power transmission mechanism for transmitting the rotation of the crankshaft to an intake camshaft in one bank and an exhaust camshaft in the other bank;

a gear mechanism for transmitting the reversal of the rotation of the exhaust camshaft in the other bank; and a rotation transmission mechanism for transmitting the rotation of the gear mechanism to an intake camshaft in the other bank.

3. The variable valve mechanism for use in the V-type internal combustion engine according to claim 1, wherein the first bank and the second bank each includes an intake camshaft for driving an intake valve and an exhaust camshaft for driving an exhaust valve;

wherein the valve bodies of the same type are the intake valves; and wherein the camshaft drive mechanism includes:

an idler gear that rotates in a direction opposite to the direction in which the crankshaft rotates;

a power transmission mechanism for transmitting the rotation of the crankshaft to an intake camshaft in one bank and an exhaust camshaft in the other bank; and a rotation transmission mechanism for transmitting the rotation of the idler gear to an intake camshaft in the other bank.

4. The variable valve mechanism for use in the V-type internal combustion engine according to claim 1, wherein the first bank and the second bank each includes an intake camshaft for driving an intake valve and an exhaust camshaft for driving an exhaust valve;

wherein the valve bodies of the same type are the intake valves; and wherein the camshaft drive mechanism includes:

a crank gear that is fastened to the crankshaft;

a first intake cam gear that is fastened to an intake camshaft in one bank;

an exhaust cam gear that is fastened to an exhaust camshaft in the other bank;

a second intake cam gear that is fastened to an intake camshaft in the other bank; and a chain or a belt that is positioned in contact with the crank gear, the first intake cam gear, and the exhaust cam gear via a front surface and in contact with the second intake cam gear via a back surface to transmit power among the gears.

5. The variable valve mechanism for use in the V-type internal combustion engine according to claim 1, wherein the first camshaft and the second camshaft are the first intake camshaft for driving an intake valve in one bank and the second intake camshaft for driving an intake valve in the other bank, respectively; and wherein the camshaft drive mechanism includes:

a first bevel gear that is fastened to the first intake cam;

a second bevel gear that is positioned to face the first bevel gear;

a third bevel gear that meshes with both the first bevel gear and the second bevel gear to transmit the rotation of the second bevel gear to the first bevel gear in such a manner that the first bevel gear rotates in a direction opposite to the direction in which the second bevel gear rotates; and a power transmission mechanism for transmitting the rotation of the crankshaft to the second intake camshaft and the second bevel gear.

6. The variable valve mechanism for use in the V-type internal combustion engine according to claim 5, further comprising a backlash buffer mechanism for pushing the third bevel gear toward the first bevel gear and the second bevel gear.

* * * * *